US008821655B1

(12) United States Patent
Saleh

(10) Patent No.: US 8,821,655 B1
(45) Date of Patent: Sep. 2, 2014

(54) HIGH STRENGTH, HIGH CONDUCTIVITY COPPER ALLOYS AND ELECTRICAL CONDUCTORS MADE THEREFROM

(75) Inventor: Joseph Saleh, Morristown, NJ (US)

(73) Assignee: Fisk Alloy Inc., Hawthorne, NJ (US)

( * ) Notice: Subject to any disclaimer, the term of this patent is extended or adjusted under 35 U.S.C. 154(b) by 163 days.

(21) Appl. No.: 12/958,788

(22) Filed: Dec. 2, 2010

(51) Int. Cl.
*C22C 9/00* (2006.01)
*C22F 1/08* (2006.01)

(52) U.S. Cl.
USPC ..... 148/432; 148/433; 148/434; 148/435; 148/436; 420/497

(58) Field of Classification Search
USPC ..... 148/432–436; 420/497
See application file for complete search history.

(56) References Cited

U.S. PATENT DOCUMENTS

| | | | | |
|---|---|---|---|---|
| 6,053,994 | A | 4/2000 | Saleh et al. | |
| 6,063,217 | A | 5/2000 | Saleh et al. | |
| 6,749,699 | B2 * | 6/2004 | Bogel et al. | 148/432 |
| 2007/0068609 | A1 | 3/2007 | Saleh | |

FOREIGN PATENT DOCUMENTS

| | | | | |
|---|---|---|---|---|
| DE | 10306819 | A1 | | 9/2004 |
| EP | 1911856 | A1 | | 4/2008 |
| JP | 60086227 | A | * | 5/1985 |
| JP | 9316569 | A | | 12/1997 |
| WO | WO2009011922 | A1 | | 1/2009 |
| WO | WO2009049201 | A1 | | 4/2009 |
| WO | WO2009123137 | A1 | | 8/2009 |
| WO | WO2009123159 | A1 | | 8/2009 |

OTHER PUBLICATIONS

International Search Report dated Aug. 19, 2011 and Written Opinion, PCT/US2011/030291, filed Mar. 29, 2011.
WO 2010084989 A1 (Furukawa Electric Co Ltd) Jul. 29, 2010.

* cited by examiner

*Primary Examiner* — Sikyin Ip
(74) *Attorney, Agent, or Firm* — Burns & Levinson LLP; Jerry Cohen

(57) ABSTRACT

A copper base alloy achieves a breakthrough electrical conductor product of strength, flexure and conductivity of minimal inverse in relationship of at least 85% IACS electrical conductivity while providing an 80 to 85 ksi tensile strength, an increase of at least 33% in strength compared to prior art and is made from an alloy containing 0.2-0.5 w/o chromium, 0.02-0.20 w/o silver and 0.04-0.16 w/o of a third metallic component selected from tin, magnesium and tin/magnesium together.

15 Claims, 4 Drawing Sheets

1 x 37

1 x 7

1 x 19

1 x 37

HIGH STRENGTH, HIGH CONDUCTIVITY COPPER ALLOYS AND ELECTRICAL CONDUCTORS MADE THEREFROM

FIELD AND BACKGROUND OF THE INVENTION

The present invention relates to copper alloys and copper alloy conductors. Copper has long been the main material used to conduct electricity. Various copper alloys have been developed to overcome shortcomings of elemental copper such as low strength and flexure life. High strength and flexure life, consistent with maintaining high conductivity, are important requirements for many applications. Cadmium copper (alloy C 16200) and cadmium-chromium-copper (alloy C 18135) have been two of the traditional copper alloys used as conductors where higher strength has been required. These alloys increase the strength of copper with a minimal reduction in its electrical conductivity, an important balance for conductor alloys. However, due to the hazardous nature of cadmium and restrictions imposed on materials containing this element, substitute alloys have been developed to replace cadmium containing alloys. The prior art also comprises the Percon 24 brand copper alloy wires made by the owner of the present invention and described in its U.S. Pat. Nos. 6,053,994 and 6,063,217, based on a common patent application filing of Sep. 12, 1997. Those wires are cadmium free yet, similar to alloy C18135, meet the ASTM B624 standards and have a composition of 0.15-1.30 weight percent (w/o) chromium, 0.01-0.15 w/o zirconium, balance copper and are specially processed as described and claimed in the '217 patent.

The art also includes examples of alloys of copper with cobalt, phosphorus, nickel, silicon, chromium including combinations often coupled with highly specialized processing requirements showing efforts to advance the art in the decade since the Percon 24 patents, as shown, e.g., in PCT published applications: WO2009/123159 ('159) (copper alloy conductor with nickel, silicon, tin, magnesium and zinc); WO 2009/123137 ('137) (Cu—Ni—Si—Co—Cr); WO 2009/11922 (Cu—Co—P—Sn with oxygen control) and WO 2009/049201 (Cu—Sn—Ni—P) optionally with special processing "at the expense of yield" to increase formability.

Alloy C17510, a beryllium copper alloy, is yet a stronger alloy than alloy C18135 with further reduction in electrical conductivity. This alloy is used to either reduce the conductor size or improve flexure life. Electrical conductivity and tensile strength for elemental copper and the C18135 and C17510 alloys are summarized below in Table 1. Required properties for alloy C18135 are outlined in the ASTM B 624 standard specification. Properties for C17510 in conductor are listed in U.S. Pat. No. 4,727,002.

TABLE 1

Properties of State of the Art Conductor Alloys

| Alloy | Electrical Conductivity, % IACS | Tensile Strength, ksi |
|---|---|---|
| Copper | 100 | 35 |
| C18135 | 85 | 60 |
| C17510 | 63 | 95 |

FIG. 1 (prior art) shows, increasing strength is associated with a decrease in electrical conductivity, i.e., these two characteristics are inversely related. The reduction in electrical conductivity with increased strength limits the use of a conductor due to increased resistance. Also, when higher strength and flexure life are required a larger and heavier conductor has to be employed to provide sufficient cross-section and load bearing capacity.

Therefore it is beneficial to obtain an alloy usable for conductors with high strength and high flexure life without sacrificing electrical conductivity or with minimal sacrifice to electrical conductivity. ASTM B 624 describes a set of properties which have been found quite useful in aerospace, medical, electronics and other applications. These properties are defined as 60 ksi tensile strength and 85% IACS electrical conductivity.

It is a main objective of the present invention to provide an environmentally friendly alloy meeting the 85% IACS electrical conductivity standard while providing an 80 to 85 ksi tensile strength, an increase of at least 33% in strength compared to prior art high strength copper alloys.

It is a further object of the invention to simplify processing of the material and obtain high yield, more cost efficient copper alloy production in wire and other forms, particularly without special control of oxygen or other interstitials content beyond customary metal fabrication good practices.

SUMMARY OF THE INVENTION

The objects are realized through production of copper conductors in wire and other forms (e.g. ribbons, mesh, strands, braids, cables) with copper base alloys of 2/10th to 6/10th of 1% (0.2-0.6%) by weight (w/o) of chromium (Cr), preferably 0.3-0.5 w/o; 0.02-0.2 w/o of silver (Ag), preferably 0.05-0.15 w/o; and 0.05-0.15 w/o of a third component of a single or multiple metals selected from the group of tin (Sn), magnesium (Mg) and Sn/Mg combined, but with any such selections in the said range. The alloy is easily producible in wire forms and easily hot and cold worked in conventional per se processing, e.g. forming as ingots by casting, extruding, drawing, optionally pickling, further drawing, typically to about 0.04-0.08 in diameter wire form, heat treating (aging), optionally coating, and drawing to final form and size typically as 30-48 AWG wire and final heat treating (annealing) usually within a range of 650-950° F. for 1 to 5 hours.

To achieve a target strength/conductivity the products of the invention may be of various length or area forms established by hot and/or cold working to various final or intermediate forms including wire, wire rod, strands, cables, braids, ropes, mesh, sheets, ribbons, buss bars, tabs, posts and the like.

Other objects, features and advantages of the invention will be apparent from the following detailed description of preferred embodiments taken in conjunction with the accompanying drawing in which:

DETAILED DESCRIPTION OF PREFERRED EMBODIMENTS

Figure 1:
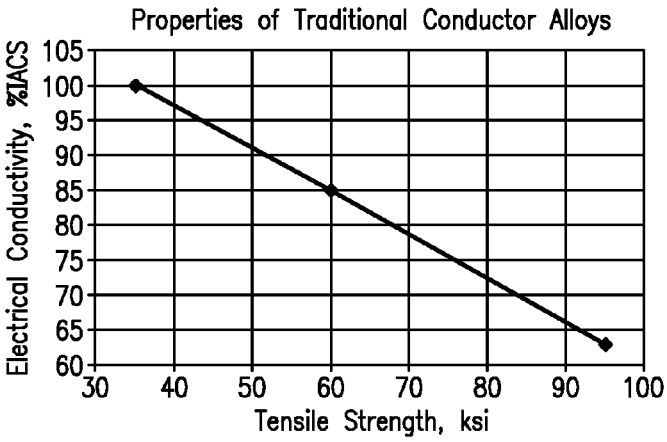
FIG. 1 is a graph showing properties of traditional (prior art) conductor alloys.

The following non-limiting examples illustrate practice of preferred embodiments of the invention for various applications.

Example 1

A series of copper alloys containing chromium, silver, magnesium and tin were cast and processed to rod on laboratory scale equipment. The significant alloy metallic chemistries are listed in Table 2 below.

TABLE 2

Laboratory Cast Alloys

| Alloy | Cu, % | Cr, % | Ag, % | Sn, % | Mg, % | Fe, % |
|---|---|---|---|---|---|---|
| 1 | Bal | 0.4 | 0.1 | 0.1 | — | — |
| 2 | Bal | 0.4 | 0.1 | 0.2 | — | — |
| 3 | Bal | 0.4 | 0.1 | — | 0.1 | — |
| 4 | Bal | 0.4 | 0.1 | — | 0.2 | — |
| 5 | Bal | 0.4 | 0.1 | 0.15 | 0.05 | — |
| 6 | Bal | 0.4 | 0.1 | — | — | 0.2 |

The material was extruded, drawn to 0.0641" diameter and annealed between 850 and 950° F. The 0.0641" wire was then drawn to 0.0144" and aged at various temperatures for 3 hours. The results are shown below for each alloy.

TABLE 3

Alloy 1 Aged at Various Temperatures for 3 Hours

| Temperature, ° F. | Tensile Strength, ksi | Elongation, % in 10" | Electrical Conductivity, % IACS |
|---|---|---|---|
| As-Drawn | 96.0 | 1.2 | 83.5 |
| 600 | 83.4 | 6.2 | 86.3 |
| 650 | 80.5 | 7.4 | 87.6 |
| 700 | 78.7 | 8.5 | 88.4 |
| 725 | 77.7 | 7.9 | 88.7 |
| 750 | 76.4 | 8.5 | 89.3 |
| 800 | 73.5 | 9.4 | 89.9 |

TABLE 4

Alloy 2 Aged at Various Temperatures for 3 Hours

| Temperature, ° F. | Tensile Strength, ksi | Elongation, % in 10" | Electrical Conductivity, % IACS |
|---|---|---|---|
| As-Drawn | 98.3 | 1.8 | 79.0 |
| 600 | 87.7 | 6.1 | 82.0 |
| 650 | 84.0 | 7.4 | 83.1 |
| 700 | 80.9 | 7.9 | 83.0 |
| 750 | 77.8 | 8.8 | 84.0 |
| 800 | 74.2 | 9.4 | 83.8 |
| 850 | 69.2 | 10.9 | 84.6 |

TABLE 5

Alloy 3 Aged at Various Temperatures for 3 Hours

| Temperature, ° F. | Tensile Strength, ksi | Elongation, % in 10" | Electrical Conductivity, % IACS |
|---|---|---|---|
| As-Drawn | 94.7 | 1.5 | 83.7 |
| 600 | 84.7 | 7.1 | 86.7 |
| 650 | 83.2 | 7.5 | 87.8 |
| 700 | 81.7 | 8.0 | 87.9 |
| 750 | 79.4 | 8.3 | 88.4 |
| 800 | 76.9 | 8.9 | 89.2 |
| 850 | 73.2 | 10.0 | 89.4 |

TABLE 6

Alloy 4 Aged at Various Temperatures for 3 Hours

| Temperature, ° F. | Tensile Strength, ksi | Elongation, % in 10" | Electrical Conductivity, % IACS |
|---|---|---|---|
| As-Drawn | 101.5 | 1.8 | 73.8 |
| 600 | 89.3 | 7.3 | 79.2 |
| 650 | 87.6 | 7.3 | 80.3 |
| 700 | 85.6 | 7.5 | 80.2 |
| 750 | 83.5 | 7.7 | 81.1 |
| 800 | 80.6 | 8.1 | 81.3 |
| 850 | 76.1 | 8.5 | 82.5 |

TABLE 7

Alloy 5 Aged at Various Temperatures for 3 Hours

| Temperature, ° F. | Tensile Strength, ksi | Elongation, % in 10" | Electrical Conductivity, % IACS |
|---|---|---|---|
| As-Drawn | 97.3 | 2.0 | 79.6 |
| 600 | 80.8 | 8.3 | 83.4 |
| 650 | 79.2 | 9.5 | 83.6 |
| 700 | 77.6 | 10.0 | 84.6 |
| 750 | 75.4 | 10.3 | 84.8 |
| 800 | 73.3 | 10.7 | 85.0 |
| 850 | 69.1 | 10.8 | 85.4 |

TABLE 8

Alloy 6 Aged at Various Temperatures for 3 Hours

| Temperature, ° F. | Tensile Strength, ksi | Elongation, % in 10" | Electrical Conductivity, % IACS |
|---|---|---|---|
| As-Drawn | 94.9 | 1.5 | 70.0 |
| 600 | 86.7 | 4.5 | 73.7 |
| 650 | 84.0 | 4.5 | 73.7 |
| 700 | 81.1 | 6.8 | 74.7 |
| 750 | 78.1 | 8.6 | 77.7 |
| 800 | 74.0 | 9.7 | 82.0 |
| 850 | 65.6 | 9.5 | 84.0 |

Figure 2:
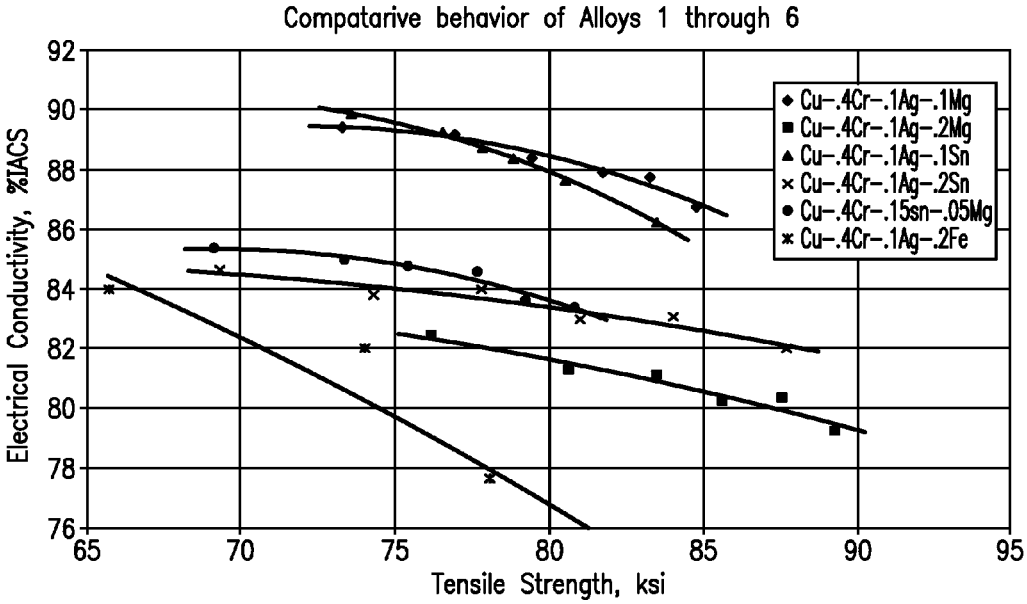
FIG. 2 is a graph showing electrical conductivity vs. tensile strength comparative behavior of alloys 1 through 6 described herein.

FIG. 2 compares the relative performance of each alloy. The Cu-0.4Cr-0.1Ag-0.1Mg (Alloy 3) and Cu-0.4Cr-0.1Ag-0.1Sn (Alloy 1) alloys are seen to exhibit the best combination of electrical conductivity and strength. Increasing Sn and Mg beyond the initial 0.1 w/o to 0.2 w/o (Alloy 4) does not improve the properties. The iron containing alloy (Alloy 6) has the worst combination of properties. The various curves of FIG. 2 should be compared to FIG. 1 and it is thus highlighted that alloys 1 and 3 are truly superior to alloys of FIG. 1.

Example 2

A copper alloy containing chromium and magnesium without silver addition was laboratory cast (Alloy 7). The composition of the alloy is shown in Table 9. The alloy was processed similarly to the alloys of example 1. The properties of the alloy 7 following different final heat treatments are shown in Table 10.

TABLE 9

Composition of Laboratory Cast Alloy 7

| Alloy | Cu, % | Cr, % | Mg, % |
|---|---|---|---|
| 7 | Bal | 0.4 | 0.15 |

TABLE 10

Alloy 7 Aged at Various Temperatures for 3 Hours

| Temperature, ° F. | Tensile Strength, ksi | Elongation, % in 10" | Electrical Conductivity, % IACS |
|---|---|---|---|
| As-Drawn | 102.2 | 1.4 | 78.5 |
| 600 | 90.9 | 6.4 | 81.9 |
| 650 | 89.9 | 7.0 | 82.0 |
| 700 | 88.0 | 7.2 | 83.7 |
| 750 | 85.3 | 7.5 | 84.2 |
| 800 | 80.0 | 8.1 | 84.7 |
| 850 | 77.0 | 8.9 | 85.4 |

Figure 3:
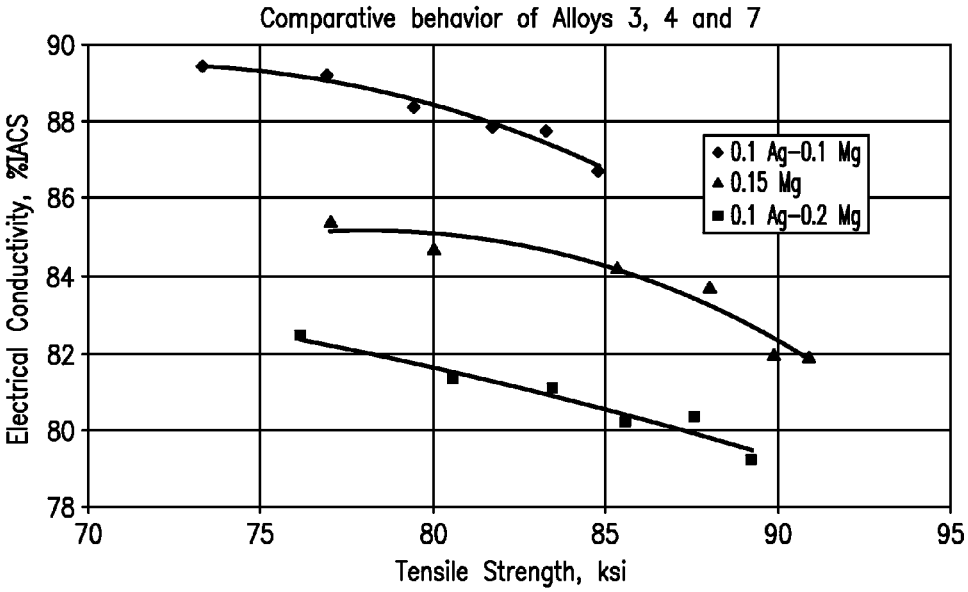
FIG. 3 is a graph showing comparative behavior of alloys 3, 4 and 7 described herein.

Properties of alloy 7 are compared with alloys 3 (Cu-0.4Cr-0.1Ag-0.1Mg) and 4 (Cu-0.4Cr-0.1Ag-0.2Mg) in FIG. 3.

Again the plots show the combination of silver and magnesium at the 0.1 w/o silver and magnesium to provide the best combination of properties.

Example 3

A series of copper chromium magnesium alloys with various silver contents were laboratory cast and processed similar to the alloys of Example 1. The significant metallic chemical composition of the alloys is listed in Table 11.

TABLE 11

Laboratory Cast Alloys with varying silver

| Alloy | Cu, % | Cr, % | Ag, % | Mg, % |
|---|---|---|---|---|
| 8 | Bal | 0.4 | 0.1 | 0.1 |
| 9 | Bal | 0.4 | 0.2 | 0.1 |
| 10 | Bal | 0.4 | 0.3 | 0.1 |
| 11 | Bal | 0.4 | 0.4 | 0.1 |

Alloy 8 has the same nominal composition as alloy 3 with alloys 9, 10 and 11 having increasing amount of silver. The alloys were drawn to 0.0140" diameter and heat treated for three hours at various temperatures. The results are tabulated in Tables 12 through 15.

TABLE 12

Alloy 8 Aged at Various Temperatures for 3 Hours

| Temperature, ° F. | Tensile Strength, ksi | Elongation, % in 10" | Electrical Conductivity, % IACS |
|---|---|---|---|
| As-Drawn | 113.5 | 2.2 | 83.2 |
| 600 | 97.6 | 5.9 | 88.3 |

TABLE 12-continued

Alloy 8 Aged at Various Temperatures for 3 Hours

| Temperature, ° F. | Tensile Strength, ksi | Elongation, % in 10" | Electrical Conductivity, % IACS |
|---|---|---|---|
| 650 | 94.9 | 5.9 | 89.6 |
| 700 | 90.4 | 6.2 | 90.8 |
| 750 | 84.7 | 7.2 | 92.3 |
| 800 | 79.5 | 7.6 | 92.0 |

TABLE 13

Alloy 9 Aged at Various Temperatures for 3 Hours

| Temperature, ° F. | Tensile Strength, ksi | Elongation, % in 10" | Electrical Conductivity, % IACS |
|---|---|---|---|
| As-Drawn | 116.9 | 1.9 | 80.4 |
| 600 | 99.1 | 4.0 | 85.8 |
| 650 | 96.0 | 5.0 | 86.7 |
| 700 | 91.0 | 6.6 | 88.0 |
| 750 | 85.7 | 7.1 | 89.8 |
| 800 | 79.4 | 7.8 | 89.2 |

TABLE 14

Alloy 10 Aged at Various Temperatures for 3 Hours

| Temperature, ° F. | Tensile Strength, ksi | Elongation, % in 10" | Electrical Conductivity, % IACS |
|---|---|---|---|
| As-Drawn | 120.6 | 2.2 | 77.5 |
| 600 | 102.7 | 5.8 | 86.2 |
| 650 | 99.3 | 6.2 | 86.7 |
| 700 | 94.7 | 6.2 | 88.0 |
| 750 | 89.6 | 6.5 | 90.6 |
| 800 | 82.4 | 7.1 | 89.8 |

TABLE 15

Alloy 11 Aged at Various Temperatures for 3 Hours

| Temperature, ° F. | Tensile Strength, ksi | Elongation, % in 10" | Electrical Conductivity, % IACS |
|---|---|---|---|
| As-Drawn | 123.3 | 2.2 | 78.6 |
| 600 | 104.5 | 5.8 | 85.3 |
| 650 | 100.4 | 6.1 | 86.1 |
| 700 | 94.8 | 5.9 | 87.3 |
| 750 | 88.8 | 6.1 | 89.0 |
| 800 | 83.0 | 7.5 | 88.6 |

The results show an increase of strength with increasing silver. The increase in strength, however, is associated with a decrease in electrical conductivity. The properties of the four alloys are compared in FIG. 4.

Alloy 8 with 0.1% silver shows the highest combination of strength and electrical conductivity. Increasing the amount of silver from 0.1% to 0.2% does not have a significant influence on the combination of properties. However, increasing the silver beyond 0.2% is detrimental and reduces the electrical conductivity at a given strength.

These alloys are intended for use as electrical conductors in single wire form, stranded or bunched. Two of the more commonly used constructions are 19/36 and 19/38 (19 single end 36 AWG or 38 AWG wires combined in a concentric arrangement) plated with silver or nickel. In order to determine the performance of these alloys in conductor form they were plated with silver and drawn to 0.0040" (38 AWG)

diameter. Conductors of 19/38 AWG construction were manufactured using the single end wires. These stranded conductors were subsequently heat treated at various temperatures and tested. The properties of these conductors are listed in Tables 16 through 19.

TABLE 16

19/38 Stranded Construction of Alloy 8 Aged for 3 Hours

| Temperature, ° F. | Tensile Strength, ksi | Elongation, % in 10" | Electrical Conductivity, % IACS |
|---|---|---|---|
| Hard | 116.6 | 2.2 | 75.3 |
| 600 | 95.9 | 4.9 | 82.9 |
| 650 | 90.9 | 5.1 | 84.4 |
| 700 | 91.9 | 5.8 | 84.5 |
| 750 | 86.5 | 6.5 | 85.7 |
| 800 | 82.5 | 7.2 | 88.4 |

TABLE 17

19/38 Stranded Construction of Alloy 9 Wires Aged for 3 Hours

| Temperature, ° F. | Tensile Strength, ksi | Elongation, % in 10" | Electrical Conductivity, % IACS |
|---|---|---|---|
| Hard | 120.9 | 1.6 | 73.2 |
| 600 | 98.6 | 7.0 | 80.8 |
| 650 | 93.6 | 6.8 | 82.4 |
| 700 | 94.1 | 7.2 | 82.2 |
| 750 | 89.2 | 7.6 | 83.1 |
| 800 | 83.9 | 8.6 | 86.2 |

TABLE 18

19/38 Stranded Construction of Alloy 10 Wires Aged for 3 Hours

| Temperature, ° F. | Tensile Strength, ksi | Elongation, % in 10" | Electrical Conductivity, % IACS |
|---|---|---|---|
| Hard | 119.6 | 1.4 | 70.1 |
| 600 | 98.6 | 5.7 | 77.7 |
| 650 | 93.5 | 6.4 | 79.6 |
| 700 | 93.6 | 6.6 | 79.9 |
| 750 | 88.3 | 7.2 | 81.1 |
| 800 | 83.6 | 8.3 | 84.1 |

TABLE 19

19/38 Stranded Construction of Alloy 11 Wires Aged for 3 Hours

| Temperature, ° F. | Tensile Strength, ksi | Elongation, % in 10" | Electrical Conductivity, % IACS |
|---|---|---|---|
| Hard | 124.6 | 1.3 | 70.1 |
| 600 | 101.2 | 5.2 | 78.3 |
| 650 | 95.4 | 6.3 | 79.7 |
| 700 | 95.9 | 6.2 | 80.1 |
| 750 | 89.8 | 7.0 | 80.9 |
| 800 | 85.1 | 7.9 | 82.9 |

Figure 4:
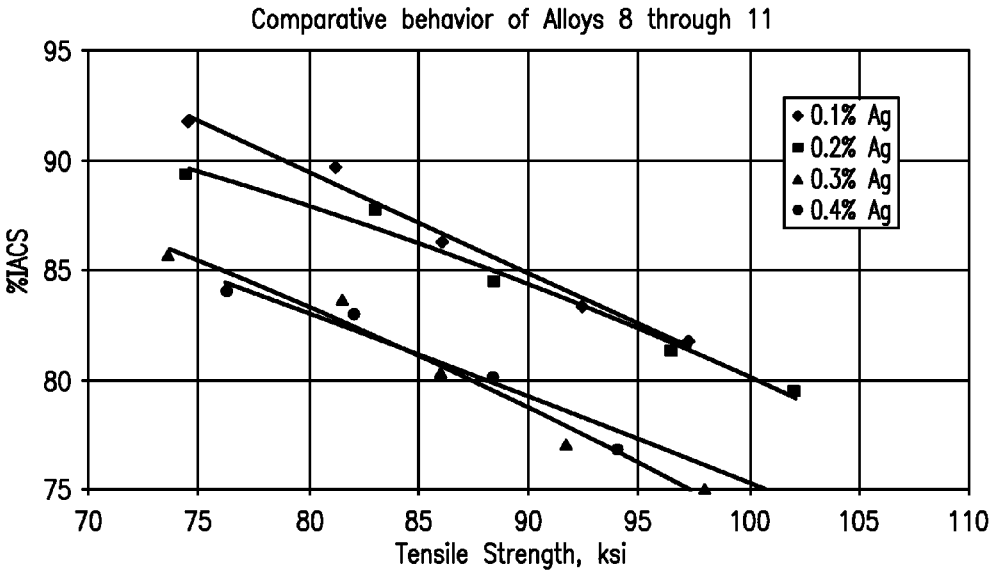
FIG. 4 is a graph showing comparative behavior of alloys 8 through 11 described herein.
Figure 5:
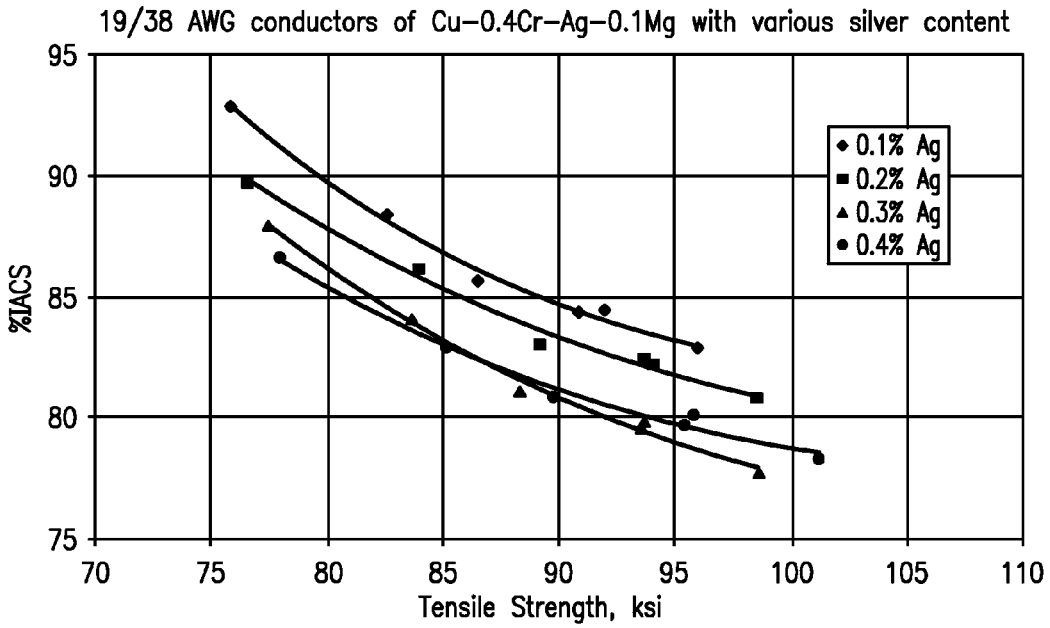
FIG. 5 is a graph showing behavior of stranded 19/38 AWG conductors of Cu-0.4 Cr—Ag-0.1 Mg with various silver contents.

Electrical conductivity versus tensile strength is plotted in FIG. 5 to compare relative performance of these alloys. A similar trend to that of the single end alloys, as illustrated in FIG. 4, is obtained. Alloy 8 shows the best combination of properties. Stranded conductors made of Alloy 8 show combination of properties at about or in excess of 85% IACS (as aged in the 600-750° F. temperature range) and 85 ksi tensile strength (as aged in the 600-750° F. temperature range).

Example 4

Based on the findings of the previous examples, three Cu—Cr—Ag—Mg/Sn alloys were produced on commercial scale equipment. The composition of these alloys is shown in Table 20.

TABLE 20

Commercially Cast Alloys

| Alloy | Cu, % | Cr, % | Ag, % | Mg, % | Sn, % |
|---|---|---|---|---|---|
| 12 | Bal. | 0.4 | 0.1 | 0.1 | 0 |
| 13 | Bal. | 0.4 | 0.1 | 0.05 | 0.05 |
| 14 | Bal. | 0.4 | 0.1 | 0 | 0.1 |

These alloys were extruded and quenched. The material was then drawn to 0.0641" diameter and heat treated between 850° F. and 950° F. The wire was then drawn to 0.0144 inch diameter and heat treated for three hours at various temperatures. The properties for the three alloys are listed in Tables 21 through 23.

TABLE 21

Alloy 12 Heat Treated for 3 Hours at Various Temperatures

| Temperature, ° F. | Tensile Strength, ksi | Elongation, % in 10" | Electrical Conductivity, % IACS |
|---|---|---|---|
| Hard | 113.0 | 2.0 | 78.2 |
| 700 | 94.5 | 6.0 | 84.0 |
| 750 | 90.3 | 6.2 | 85.0 |
| 800 | 84.1 | 6.5 | 85.9 |
| 850 | 76.0 | 7.0 | 86.8 |
| 900 | 66.6 | 9.0 | 88.1 |

TABLE 22

Alloy 13 Heat Treated for 3 Hours at Various Temperatures

| Temperature, ° F. | Tensile Strength, ksi | Elongation, % in 10" | Electrical Conductivity, % IACS |
|---|---|---|---|
| Hard | 109.4 | 2.0 | 79.5 |
| 700 | 91.2 | 5.0 | 85.7 |
| 750 | 86.6 | 5.2 | 86.8 |
| 800 | 79.7 | 6.0 | 87.5 |
| 850 | 71.1 | 7.0 | 88.2 |
| 900 | 60.6 | 11.5 | 89.6 |

TABLE 23

Alloy 14 Heat Treated for 3 Hours at Various Temperatures

| Temperature, ° F. | Tensile Strength, ksi | Elongation, % in 10" | Electrical Conductivity, % IACS |
|---|---|---|---|
| Hard | 112.4 | 2.0 | 73.2 |
| 700 | 92.2 | 4.0 | 83.1 |
| 750 | 85.0 | 5.8 | 85.9 |
| 800 | 75.0 | 6.8 | 87.8 |
| 850 | 63.8 | 11.5 | 89.0 |
| 900 | 55.5 | 13.0 | 90.2 |

Figure 6:
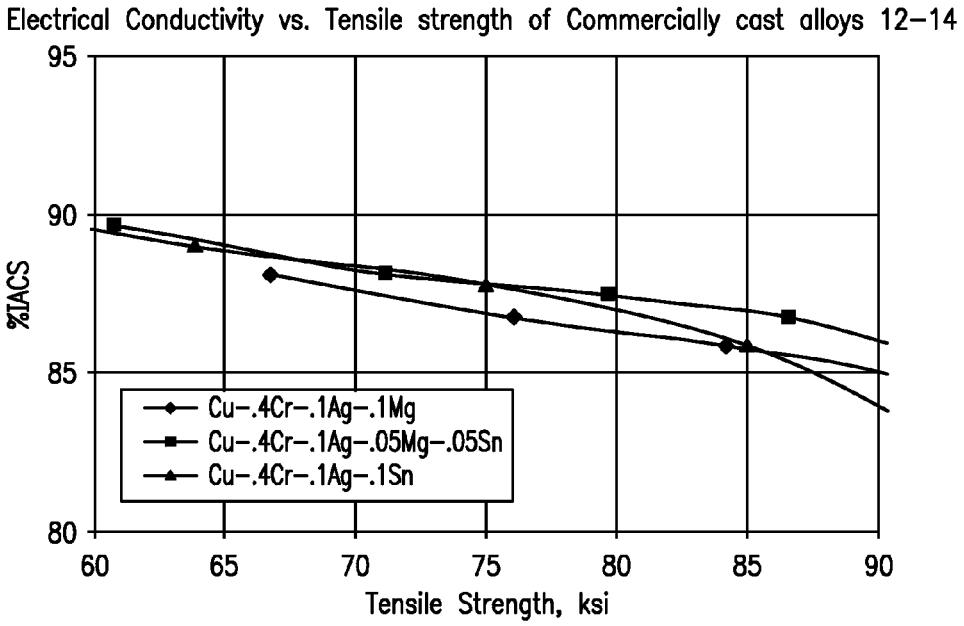
FIG. 6 is a graph showing electrical conductivity versus tensile strength behavior of commercially cast alloys 12-14 described herein.

The electrical conductivity and tensile strength of these three commercially cast alloys are compared in FIG. 6. No significant difference is found among the three alloys in the above data but there are differences among the alloys in their softening responses. To reach the same set of properties the Mg containing alloy must be annealed at a higher temperature. This indicates a greater softening resistance. Softening resistance is one of the requirements in certain applications such as those insulated with high temperature insulation.

Figure 7A:
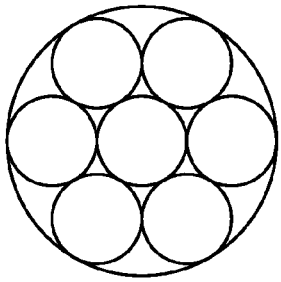
FIGS. 7*a*-7*c* are cross-section sketches of typical stranded conductor configurations.
Figure 7B:
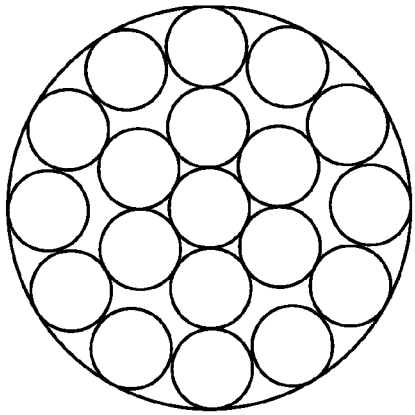
Figure 7C:
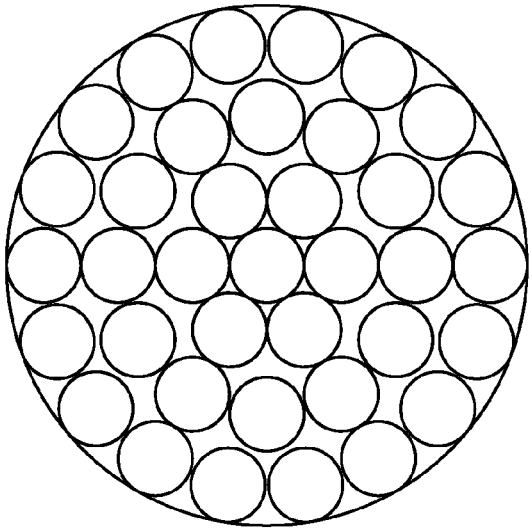

The alloy wires may be stranded in traditional forms e.g. as illustrated in FIGS. 7*a*-7*c*. See also U.S. Pat. No. 7,544,886 for cable construction generally.

In order to determine the properties of these alloys in stranded conductor form, alloy 12 wire (Cu-0.4Cr-0.1Ag-0.1Mg) was silver plated and made into a 19/38 stranded construction (see FIG. 7*b*). Samples of this conductor were heat treated at various temperatures to determine the optimum heat treatment temperature. The results are shown below.

TABLE 24

19/38 Stranded Conductor Construction of Alloy 12 Heat Treated for 3 Hours at Various Temperatures

| Temperature, ° F. | Tensile Strength, ksi | Elongation, % in 10" | Electrical Conductivity, % IACS |
|---|---|---|---|
| Hard | 128.7 | 1.4 | 68.3 |
| 600 | 110.5 | 2.2 | 76.4 |
| 650 | 105.2 | 3.6 | 77.1 |
| 700 | 100.4 | 6.2 | 80.5 |
| 750 | 92.5 | 6.8 | 85.4 |
| 810 | 80.2 | 8.2 | 87.5 |
| 850 | 74.7 | 9.7 | 88.4 |

The results indicate the capability of this alloy to exceed the requirements established for this material in the present invention, namely, minimum of 80 ksi tensile strength, 85% IACS electrical conductivity and 6% elongation.

A larger spool of this stranded conductor was then heat treated at an appropriate temperature to obtain desired properties for additional testing. The properties of this conductor are listed in Table 25. The combination of properties exceeds the goals of the present invention.

TABLE 25

19/38 Conductor Construction of Alloy 12 Heat Treated for 3 Hours at 765° F.

| Temperature, ° F. | Tensile Strength, ksi | Elongation, % in 10" | Electrical Conductivity, % IACS |
|---|---|---|---|
| 765 | 89.6 | 7.9 | 85.8 |

High flexure life is a highly desirable attribute for a conductor. A test for flexure life for a conductor is described in ASTM B 470. In this test the conductor under a predefined load is bent back and forth around a mandrel of a given diameter at a given rate. The number of cycles to failure is then recorded. Flexure life of the alloy 12 (Cu-0.4Cr-0.1Ag-0.1Mg) conductor of Table 25 was compared to a standard high strength conductor meeting the requirements of ASTM B 624 (listed in Table 1.) Two different alloys meeting the requirements of ASTM B624 are represented in Table 26. The table lists both break load and average flexure life for the conductors tested. The increase in flexure life relative to ASTM B624 alloys is substantial.

TABLE 26

Flex Life for 19/38 Conductor of Alloy 12 Compared with ASTM B 624 Alloys

| ASTM B 624 Alloy | | Alloy of This invention | |
|---|---|---|---|
| Break Load, lbs | Flex Life | Break Load, lbs | Flex Life |
| 15.1-15.5 | 7,424-7,820 | 20.5 | 20,551 |

It will now be apparent to those skilled in the art that other embodiments, improvements, details, and uses can be made consistent with the letter and spirit of the foregoing disclosure and within the scope of this invention, which is limited only by the following claims, construed in accordance with the patent law, including the doctrine of equivalents.

The invention claimed is:

1. A copper base alloy conductor product of hot or cold worked and final heat treated forms made of an alloy composition consisting of:

(a) 0.2-0.6 w/o chromium, (b) 0.02-0.20 w/o silver, (c) 0.04-0.16 w/o of a third metallic component selected from the group consisting of tin, magnesium and tin/magnesium combined, and (d) balance copper, the product having a tensile strength of at least 80 ksi, at least 6% elongation and at least 85% IACS electrical conductivity.

2. A copper base alloy conductor product of hot or cold worked and final heat treated form as a wire of 30 AWG or smaller diameter made of an alloy composition consisting of:

(a) 0.2-0.6 w/o chromium, (b) 0.02-0.20 w/o silver, (c) 0.04-0.16 w/o of a third metallic component selected from the group consisting of tin, magnesium and tin/magnesium combined, and (d) balance copper, the product having a tensile strength of at least 80 ksi, at least 6% elongation and at least 85% IACS electrical conductivity.

3. The product of either of claim 1 or 2 wherein the compositional range of component (b) is 0.05-0.15 w/o.

4. The product of either of claim 1 or 2 wherein the compositional range of components (a) and (b) are from 0.3-0.5 w/o for (a) and 0.05-0.15 w/o for (b).

5. The product of either of claim 1 or 2 where component (c) consists essentially of magnesium.

6. The product of either of claim 1 or 2 where component (c) consists essentially of tin.

7. The product of any of claim 1 or 2 where component (c) consists essentially of tin/magnesium combined.

8. The product of any of claim 1 or 2 in single wire form of 30 AWG or smaller diameter.

9. The wire product of claim 8 in stranded, bunched, rope, cable or other multi-conductor forms.

10. The product of either of claim 1 or 2 wherein the compositional range of component (a) is 0.3-0.5 w/o.

11. The conductor product of claim 2 as a wire with a diameter in the range of 30-48 AWG.

12. The wire product of claim 11 with a wire diameter in the range of 30-48 with an electrical conductivity in the range of 85-95% IACS and a tensile strength range of 80-90 ksi.

13. The wire product of claim 11 as a wire with a diameter in the range of 30-48 AWG, an electrical conductivity in the range of 85-95% IACS and a tensile strength range of 80-85 ksi.

14. The wire product of claim 2 with a wire diameter of 30 AWG or smaller, a tensile strength in the range of 80-90 ksi.

15. A wire product made of an alloy consisting of:

(a) 0.2-0.6 w/o chromium, (b) 0.02-0.20 w/o silver, (c) 0.08-0.15 w/o of a third metallic component selected from the group consisting of tin, magnesium and tin/magnesium combined, and (d) balance copper.

* * * * *